US005667437A

United States Patent [19]

Donnelly

[11] Patent Number: 5,667,437

[45] Date of Patent: Sep. 16, 1997

[54] AIR DIFFUSER

[75] Inventor: William James Donnelly, Ivanhoe, Australia

[73] Assignee: Talana Investments Limited, Tortola, Virgin Islands (Br.)

[21] Appl. No.: 561,608

[22] Filed: Nov. 21, 1995

[30] Foreign Application Priority Data

Nov. 23, 1994 [AU] Australia ..... PM 9628

[51] Int. Cl.[6] ..... F24F 13/062

[52] U.S. Cl. ..... 454/302; 454/303

[58] Field of Search ..... 454/286, 302, 454/303, 304, 305

[56] References Cited

U.S. PATENT DOCUMENTS

| | | | |
|---|---|---|---|
| 3,292,522 | 12/1966 | Shur | 454/302 |
| 5,107,755 | 4/1992 | Leban et al. | 454/302 |

FOREIGN PATENT DOCUMENTS

| | | | |
|---|---|---|---|
| 30 00 534 | 7/1981 | Germany | 454/302 |
| 2005283 | 12/1993 | Russian Federation | 454/305 |

*Primary Examiner*—Harold Joyce

*Attorney, Agent, or Firm*—Greer, Burns & Crain, Ltd.

[57] ABSTRACT

An air diffuser for diffusing conditioned air into a room has a diffuser body mounted in a housing to define an air channel which narrows towards the outlet end of the housing to produce a venturi-like effect causing the air to speed up as it leaves the diffuser so that the conditioned air can penetrate stratified layers of air in the room. The diffuser body is of tapered form having a narrow upper end portion and a wider lower end portion disposed in the open, outlet end of the housing. The diffuser body has a surface which faces the internal surface of a sloping side wall of the housing and which is inclined at an angle to the vertical greater than that of the sloping side wall of the housing to provide the narrowing air channel. The diffuser body is adjustably mounted for movement relative to the housing so that the flow of conditioned air leaving the outlet end of the housing can be adjusted.

16 Claims, 2 Drawing Sheets

AIR DIFFUSER

This invention relates to an air diffuser for diffusing air, which is fed from an air duct, into an open space.

In particular this invention relates to an air diffuser mounted in or near the ceiling of a room and connected to air conditioning ducts to provide controlled diffusion of conditioned air throughout the room. However it will be appreciated that the invention may be used to diffuse air from ducts located in other positions.

Generally air conditioning ducts lead from a central air conditioning plant to a plurality of rooms. Large ducts are used to provide sufficient air flow and to minimize resistance to the air flow over the long distances the air must travel. Smaller ducts lead from the large ducts to each room. Since large air pressures are required to provide the required air flow and there are different requirements for air flow in each room, a method of control of the air flow is required.

In one known air conditioning system, the ducting includes complex baffle and control arrangements for ensuring the required flow of air along the air ducts to each room. Diffusers mounted at the end of the air duct open into each room to spread the air throughout the room. However, often the air in the room has stratified into different temperature layers and the force of the diffused air is not sufficient to penetrate all of the layers. Therefore people located in a lower portion of the room may not feel or experience the air conditioning as its effect may be limited to a top portion of the room. Also, in order to change the effect of the air conditioning in any particular room, the control settings must be adjusted to alter the flow in any one duct which often affects the air flow in other ducts.

It is therefore desirable to provide an air diffuser which can overcome the effect of temperature stratification of the air in a room and provide the required air conditioning effect in the lower portion of the room. It is also desirable to provide an air diffuser which allows adjustment of the flow of conditioned air to accommodate the preferences of the people in the room, without having to use complicated controls.

According to one aspect of the invention, there is provided an air diffuser comprising a housing and a diffuser body mounted within the housing, the housing having at least one wall extending between a first, inlet end adapted for connection to an air duet and a second, open end forming an outlet for air, the arrangement of the housing and diffuser body being such that an air channel formed between an internal surface of the housing wall and the diffuser body narrows towards said second, open end of the housing.

In use, the narrowing air channel of the diffuser produces a venturi-like effect on the air passing through the diffuser causing the air to speed up as it exits the diffuser so as to penetrate stratified air layers in the room or other space where the diffuser is mounted. The diffuser therefore provides better diffusion of conditioned air throughout the entire room or other space and when mounted in a ceiling enables conditioned air to reach the lower region of the room.

The diffuser body is preferably adjustably mounted so as to be movable relative to the housing between different positions.

In accordance with another aspect of the invention, there is provided an air diffuser comprising a housing having at least one wail extending between a first inlet end adapted for connection to an air duct and a second, open end forming an outlet for air, and a diffuser body mounted within the housing to form an air channel between the internal surface of the housing wall and the diffuser body, wherein the diffuser body is adjustably mounted so as to be movable relative to the housing between different positions.

The adjustable mounting of the diffuser body allows the size and orientation of the air channel and the size of the air outlet to be altered enabling the air flow into the room or other space to be adjusted. Thus the air flow can be adjusted to provide a gentle diffusion, a more rapid air flow or a different direction of air flow, without having to alter the total flow of air through the diffuser.

The diffuser body may be mounted for adjustment relative to the diffuser housing by any convenient adjustable mounting means. In a preferred embodiment, the adjustable mounting means comprises at least one crane means having two or more arms connected by pivotal joints. One end of the crane means may be mounted to the housing or to the ceiling on which the housing is mounted, the other end of the crane being attached to the diffuser body so that the diffuser body is suspended within the housing by the at least one crane means.

The diffuser body is preferably of tapered form having a wall or walls extending from a narrow end portion to a wider opposite end portion. The shape of the housing and diffuser body may take a variety of forms to provide the desired venturi-like effect. Preferably, the diffuser body has at least one external surface opposed to an internal surface of a wall of the housing and which extends at an angle relative to said internal surface to provide a narrowing air channel between the internal surface of the housing wall and the external surface of the diffuser body.

In one preferred embodiment, the housing is of generally rectangular form having opposed pairs of side walls and the diffuser body is generally in the form of a rectangular pyramid or truncated pyramid having sloping side surfaces, each of which faces an internal surface of a respective side wall of the housing. Each wall of the rectangular housing preferably has a first, vertical wall portion forming part of the air inlet and a second sloping wall portion inclined at a lesser angle to the vertical than the sloping surfaces of the diffuser body.

In an alternative embodiment, the housing may be of a generally circular form having a cylindrical or at least partly conical wall, with the diffuser being conical or frusto-conical in shape having an external surface facing the internal surface of the housing wall.

In order that the invention may be more readily understood a particular embodiment thereof will now be described, by way of example only, with reference to the accompanying drawings wherein.

Figure 1:
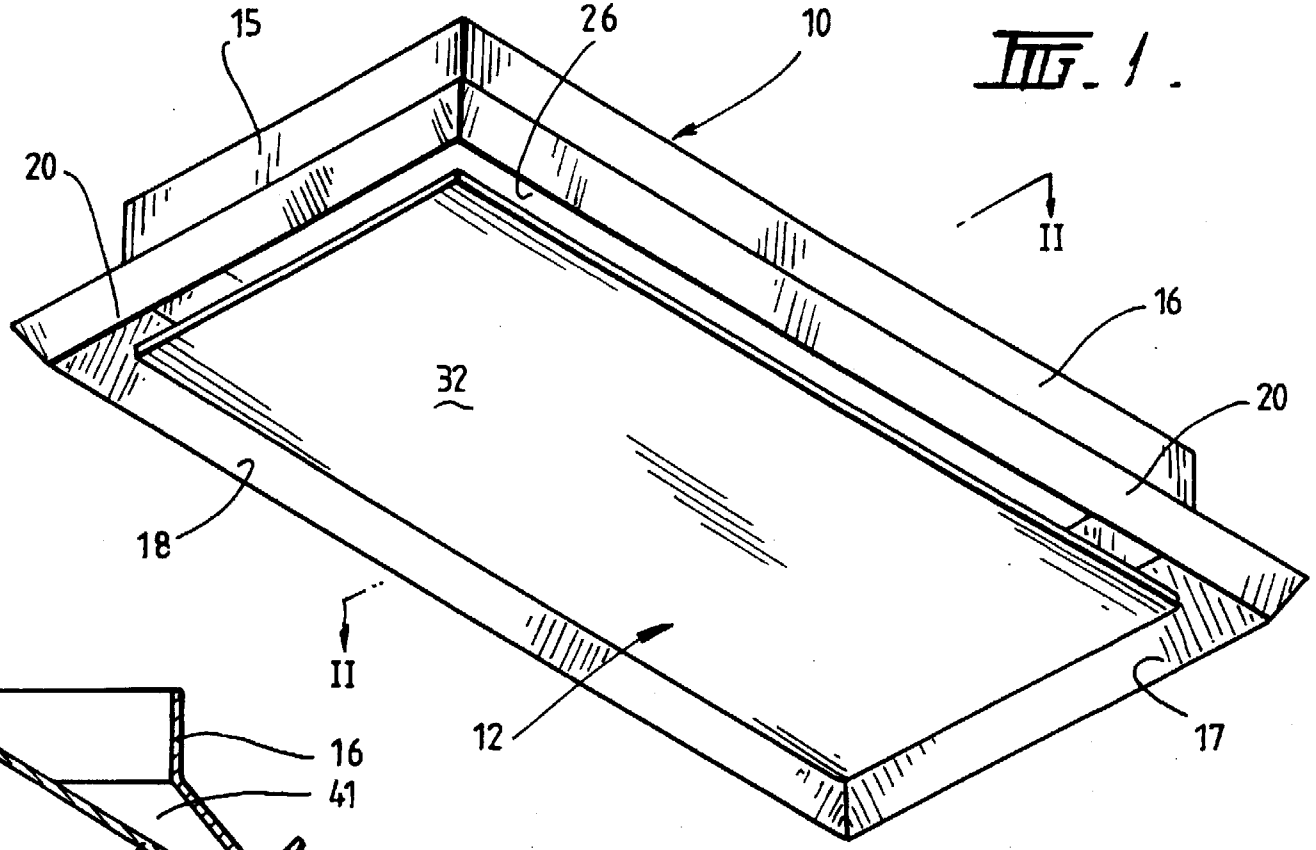
FIG. 1 is an underneath perspective view of an air diffuser in accordance with a first embodiment of the invention.

Referring to the drawings there is shown an air diffuser in accordance with the invention comprising a rectangular housing 10 and a diffuser body 12 adjustably mounted within the housing 10.

The rectangular housing 10 is adapted to be mounted in a rectangular opening in a ceiling of a room and has an air inlet 14 at its upper end formed by opposed pairs of upper end and side wall potions 15 and 16 and a lower air outlet 26 defined by lower end and side wall potions 17 and 18. Each upper wall potion 15, 16 is substantially parallel to its opposite wall potion and each lower wall potion 17, 18 extends downwardly and outwardly from the lower end of a respective upper wall potion 15, 16. An upturned peripheral flange 20 extends around the lower ends of the end and side wall potions 17, 18 to hide sealing material which extends around the upper wall potions 15 and 16 when the housing is mounted in the ceiling.

The diffuser body 12 adjustably mounted within the housing comprises a rectangular pyramid striped body part 33 having sloping end and side walls 31 and 34 extending from an upper ridge portion to an open rectangular lower end 35 that is closed by a flat display plate 32. The display plate 32 is attached to the body part 33 by screws which are screwed into screw holes 37 in protruding tubes 36 formed on the inside of the body part 33. The sloping walls 31 and 34 of the body part 33 are inclined at an angle to the vertical which is greater than the angle at which the lower wall portions 17 and 18 of the housing 10 are inclined to the vertical so that the air channel 41 formed between the external surfaces of the walls 31 and 34 of the diffuser body 12 and the internal surfaces of the wall potions 17 and 18 of the housing 10 narrows towards the outlet 26.

The diffuser body 12 is retained in position in the outlet 26 of the housing 10 by two cranes 51 each of which is mounted on a ceiling support 52 received in a slot 53 in one of the upper side wall potions 16. Each crane 51 has a pair of pivotally connected arms 54 and 55, connected together by a spring locked ball joint 56. One arm 54 of the crane is pivotally connected to the support 52 by another spring locked ball joint, and the other arm 55 of the crane has a bolt 58 which can be inserted through a respective bolt hole 38 provided at the top of the diffuser body 31 and retained by nuts or the like. The spring locked ball joints allow for adjustment of the position of the diffuser body 12 relative to the housing 16 and enable the diffuser body to be retained in different positions.

Figure 2:
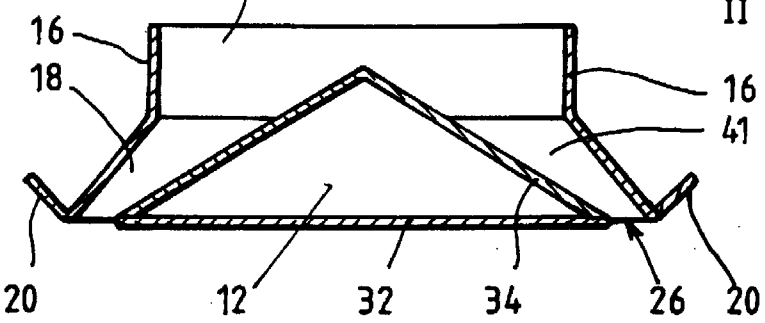
FIG. 2 is a section on the line II—II of FIG. 1.
Figure 3:
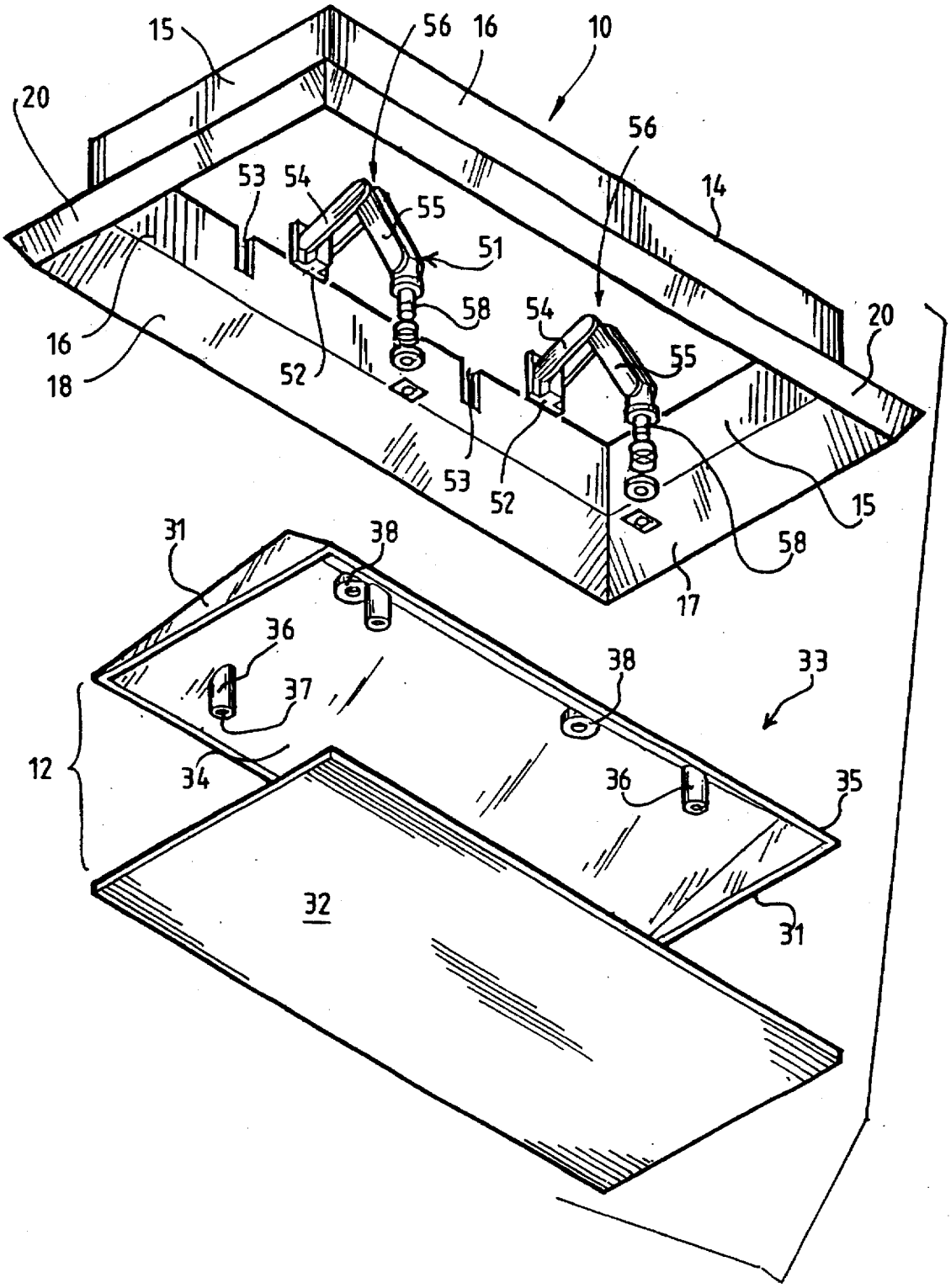
FIG. 3 is an underneath exploded perspective view of the air diffuser of FIG. 1.

As is apparent from FIG. 2, the air channel 41 surrounding the diffuser body and formed between the end and side walls 31 and 34 of the diffuser body 31 and the internal surfaces of the wall portions 17 and 18 of the narrows towards the outlet 26. Thus, in use, air passing through the diffuser from the inlet 14 proceeds down the narrowing air channel 41 which produces a venturi-like effect on the air flow such that it speeds up by the time it reaches the outlet 26. The exiting air flow is thereby able to penetrate stratified air layers in a room while also being diffused over an extended area 26. In one preferred embodiment, the dimensions of the housing 10 and diffuser body 12 are such that the cross-sectional area of the air inlet 14 is one and half times the area of the air outlet 26.

By moving the diffuser body 12 to different positions within the housing 10 the angle and velocity of the exiting air can be modified according to the wishes of the user.

It should be evident from the description hereinabove that the present invention provides an improved air diffuser which avoids most if not all of the disadvantages of the prior art. Of course many modifications of the above described embodiment may be readily envisaged by persons skilled in the art. For example the housing may be of circular form with a conical or frusto-conical shaped diffuser body used to define the air channel. Also, other forms of adjustable mountings instead of the cranes may be used.

Since modifications within the spirit and scope of the invention may be readily effected by persons skilled in the art, it is to be understood that the invention is not limited to the particular embodiment described, by way of example, hereinabove.

I claim:

1. An air diffuser comprising a housing and a diffuser body mounted within said housing, said housing having a first, inlet end adapted for connection to an air duct, a second, open end forming an outlet for air, and at least one housing wall extending from said inlet end to said second, open end, wherein said diffuser body is mounted within said housing so as to form an air channel between said wall of said housing and said diffuser body which narrows towards said second, open end of the housing, said air diffuser further comprising at least one crane means for adjustably mounting said diffuser body within said housing, said crane means having at least two arms connected by a pivotal joint and a support means fixed relative to said housing, one of said arms being pivotally connected to said support means and another of said arms being pivotally connected to said diffuser body.

2. An air diffuser according to claim 1 wherein said diffuser body has at least one surface opposed to an internal surface of said housing wall and said surface of the diffuser body extends at an angle relative to said internal surface so that the narrowing air channel between said surfaces produces a venturi-like effect on air passing through the diffuser.

3. An air diffuser according to claim 2 wherein said diffuser body is of tapered form having a narrow end portion and a wider opposite end portion, said wider opposite end portion being disposed in said second, open end of said housing.

4. An air diffuser according to claim 3 wherein said housing has at least one side wall having a first, substantially vertical wall portion forming part of an air inlet at said inlet end and a second, sloping wall portion extending outwardly from said first wall portion at an angle inclined to the vertical.

5. An air diffuser according to claim 4 wherein said diffuser body has a sloping surface facing said sloping wall portion of said side wall of said housing and said sloping surface is inclined to the vertical at a greater angle than said sloping wall portion.

6. An air diffuser according to claim 3 wherein said housing is of generally rectangular form having opposed pairs of side walls and said diffuser body comprises a substantially rectangular pyramid having sloping side surfaces, each side surface facing an internal surface of a respective side wall of the housing.

7. An air diffuser according to claim 1 wherein said crane means includes pivotal connections in the form of spring-loaded ball joints.

8. An air diffuser comprising:

a housing having a first, inlet end adapted for connection to an air duct, a second, open end forming an outlet for air and at least one housing wall extending from said first, inlet end to said second, outlet end;

a diffuser body mounted within said housing to form an air channel between said housing wall and said diffuser body; and an adjustable mounting for said diffuser body whereby said diffuser body is movable relative to the housing, wherein said adjustable mounting comprises at least one crane means having at least two pivotally connected arms and a support means fixed relative to said housing, one of said pivotally connected arms being pivotally connected to the support means and another of the pivotally connected arms being pivotally connected to the diffuser body.

9. An air diffuser according to claim 8 wherein said crane means includes pivotal connections in the form of spring-loaded ball joints.

10. An air diffuser according to claim 8 wherein said diffuser body has at least one surface opposed to an internal surface of said housing wall, said surface of the diffuser body extending at an angle relative to said internal surface so that an air channel formed between said surface of said diffuser body and said internal surface of said housing wall narrows towards said second, outlet end of said housing.

11. An air diffuser according to claim 8 wherein said diffuser body is of tapered form having a narrow end portion and a wider, opposite end portion, said wider, opposite end portion being disposed substantially in said second, open end of said housing.

12. An air diffuser according to claim 8 wherein said diffuser housing has at least one side wall having a first, substantially vertical wall portion at said first, inlet end and a second sloping wall potion which extends outwardly from said first wall portion at an angle inclined to the vertical.

13. An air diffuser according to claim 12 wherein said diffuser body has a sloping surface facing said sloping wall portion of said housing and said sloping surface is inclined at a greater angle to the vertical than said sloping wall portion of said side wall of said housing.

14. An air diffuser according to claim 8 wherein said diffuser housing and said diffuser body are both of elongated form and said adjustable mounting comprises two or more of said crane means.

15. An air diffuser according to claim 14 wherein said housing is of generally rectangular form having opposed pairs of side walls and said diffuser body comprises a substantially rectangular pyramid having sloping side surfaces, each side surface facing an internal surface of a respective side wall of the housing.

16. An air diffuser according to claim 14 wherein each of said crane means includes pivotal connections in the form of spring-loaded ball joints.

* * * * *